US011530795B2

(12) United States Patent
Kang

(10) Patent No.: US 11,530,795 B2
(45) Date of Patent: Dec. 20, 2022

(54) LAMP FOR VEHICLE

(71) Applicant: HYUNDAI MOBIS CO., LTD., Seoul (KR)

(72) Inventor: Hyun Woo Kang, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/510,552

(22) Filed: Oct. 26, 2021

(65) Prior Publication Data

US 2022/0128216 A1 Apr. 28, 2022

(30) Foreign Application Priority Data

Oct. 26, 2020 (KR) ..... 10-2020-0139706
Nov. 20, 2020 (KR) ..... 10-2020-0156978

(51) Int. Cl.
*F21V 7/00* (2006.01)
*F21S 45/47* (2018.01)
*F21S 41/33* (2018.01)

(52) U.S. Cl.
CPC ..... *F21S 45/47* (2018.01); *F21S 41/334* (2018.01)

(58) Field of Classification Search
CPC ..... F21S 45/47; F21S 41/334; F21S 43/14; F21S 43/195; F21S 41/192; F21S 41/151; B60Q 3/60; B60Q 3/82; H03K 17/962; H05K 2201/10106; H05K 2201/0166; H05K 2201/10575; H05K 1/0206; H05K 1/021; H01L 2924/181; H01L 33/644
USPC ..... 362/509, 23.03, 23.04, 85, 88, 94, 95, 362/111, 114, 204, 205, 212, 249.05, 362/249.12, 394, 395, 265
See application file for complete search history.

(56) References Cited

U.S. PATENT DOCUMENTS

2007/0047238 A1* 3/2007 Vukosic ..... F21V 29/70 362/368
2010/0039814 A1* 2/2010 Germain ..... G09F 13/22 362/346

FOREIGN PATENT DOCUMENTS

JP 2010283063 A * 12/2010
KR 20160024189 A * 6/2009

* cited by examiner

*Primary Examiner* — Omar Rojas Cadima
(74) *Attorney, Agent, or Firm* — NovoTechIP International PLLC

(57) ABSTRACT

The present disclosure relates to a lamp for a vehicle, the lamp including: a board; a light source disposed on one surface of the board; and a reflector configured to transfer heat to the board and receive heat from the board and having a reflective surface for reflecting light emitted from the light source, thereby simplifying a structure and improving spatial utilization and a degree of design freedom.

8 Claims, 12 Drawing Sheets

LAMP FOR VEHICLE

CROSS-REFERENCE TO RELATED APPLICATIONS

This application claims priority to and the benefit of Korean Patent Application No. 10-2020-0139706 filed on Oct. 26, 2020 and Korean Patent Application No. 10-2020-0156978 filed on Nov. 20, 2020, the entire contents of which are incorporated herein by reference.

BACKGROUND OF THE INVENTION

1. Field of the Invention

The present disclosure relates to a lamp for a vehicle, and more particularly, to a lamp for a vehicle, which is capable of having a simplified structure and improved spatial utilization and degree of design freedom.

2. Discussion of Related Art

In general, a vehicle includes various types of lamps having a lighting function and a signal function. The lighting function allows a driver to easily recognize objects positioned around the vehicle during the nighttime driving. The signal function informs drivers in other vehicles and pedestrians on the road of a traveling state of the host vehicle.

For example, the lamps include headlamps (or headlights) and fog lamps mainly used for the lighting function, and turn signal lamps, tail lamps, brake lamps, and side markers used for the signal function. The regulations define the installation criteria and specifications of these lamps for a vehicle to enable the lamps to sufficiently exhibit the functions.

Among the lamps for a vehicle, the headlamp provides a low-beam pattern or a high-beam pattern to ensure a front visual field of a driver during the nighttime driving. The headlamp plays a significantly important role in safe driving.

Meanwhile, a light source (e.g., an LED) of the headlamp generates high-temperature heat when emitting light, and luminous efficiency and lifespan of the light source may deteriorate when a temperature of the headlamp (e.g., a temperature of the light source) is raised to a certain degree or more. Therefore, the temperature of the headlamp needs to be maintained under an appropriate temperature condition.

In the related art, there has been proposed a method of dissipating heat, which is generated from the light source, to the outside by using a heat dissipation member (e.g., a heat sink) mounted on a board on which the light source (LED) is mounted and by transferring the heat, which is generated from the light source, to the heat dissipation member via the board.

However, in the related art, the separate heat dissipation member needs to be provided to dissipate the heat generated from the light source, which complicates a structure, degrades spatial utilization and a degree of design freedom, and increases costs.

Therefore, recently, various studies have been conducted to ensure heat dissipation properties of the light source, simplify the structure, and improve the spatial utilization and the degree of design freedom, but the study results are still insufficient. Accordingly, there is a need to develop a technology to ensure the heat dissipation properties of the light source, simplify the structure, and improve the spatial utilization and the degree of design freedom.

In addition, a halogen lamp or an HID lamp has been used as the light source of the lamp for a vehicle. However, recently, an LED is used as the light source. The LED may cause less eye strain, minimize a size of the lamp, and improve a degree of design freedom of the lamp for a vehicle. The LED also has a semipermanent lifespan, which improves economic feasibility.

When the LED is used as the light source of the lamp for a vehicle, the heat generated from the LED degrades light distribution properties and high-temperature operational reliability. Recently, the amount of generated heat further increases as a high-performance LED is used for the lamp for a vehicle, which causes a deterioration in luminous efficiency of the LED. Accordingly, there is a need to design a heat dissipation structure capable of efficiently dissipating heat from a lamp for a vehicle that uses a light source such as an LED that generates a large amount of heat.

BRIEF SUMMARY OF THE INVENTION

The present disclosure has been made in an effort to provide a lamp for a vehicle, which is capable of having a simplified structure and improving spatial utilization and a degree of design freedom.

In particular, the present disclosure has been made in an effort to dissipate heat generated from a light source using a reflector.

The present disclosure has also been made in an effort to shorten a dissipation route of heat generated from a light source and improve heat dissipation performance.

The present disclosure has also been made in an effort to improve operational stability and reliability of a light source and prolong a lifespan of the light source.

The present disclosure has also been made in an effort to simplify a structure and a manufacturing process and reduce costs.

The present disclosure has also been made in an effort to provide a lamp for a vehicle, in which a shape of a heat dissipation fin provided on a heat dissipation part is improved, and a heat dissipation fan is disposed at a rear end of a heat sink, thereby improving heat dissipation performance.

The present disclosure has also been made in an effort to provide a lamp for a vehicle, which maximizes heat dissipation performance by improving a shape of a heat sink and a shape of a lens holder and thus allowing a light source part to be directly cooled by air allowed to flow by a heat dissipation fan.

The present disclosure has also been made in an effort to provide a lamp for a vehicle, in which a size of a heat sink is reduced by optimizing heat dissipation performance, thereby reducing costs and allowing the heat sink to be used in common for various lamp modules.

The objects to be achieved by the embodiments are not limited to the above-mentioned objects, but also include objects or effects that may be understood from the solutions or embodiments described below.

An exemplary embodiment of the present disclosure provides a lamp for a vehicle, the lamp including: a board; a light source disposed on one surface of the board; and a reflector configured to transfer heat to the board and receive heat from the board and having a reflective surface for reflecting light beams emitted from the light source.

This is to simplify a structure of the lamp and improve spatial utilization and a degree of design freedom.

That is, in the related art, a separate heat dissipation member (e.g., a heat sink) needs to be mounted on the board to dissipate the heat generated from the light source, which complicates a structure, degrades spatial utilization and a degree of design freedom, and increases costs.

However, according to the embodiment of the present disclosure, the reflector is used to dissipate the heat generated from the light source without the separate heat dissipation member. Therefore, it is possible to obtain an advantageous effect of simplify the structure and the manufacturing process and improving the spatial utilization and the degree of design freedom.

According to the exemplary embodiment of the present disclosure, the reflector may be made of a thermally conductive material, and heat generated from the light source may be dissipated through the reflector.

For example, the reflector may be made of at least any one of thermally conductive plastic and thermally conductive metal.

According to the exemplary embodiment of the present disclosure, the lamp for a vehicle may include: a first contact part disposed on the board; and a second contact part disposed on the reflector and being in contact with the first contact part and configured to transfer heat to the first contact part and receive heat from the first contact part.

In particular, the first contact part may be in surface contact with the second contact part. Since the second contact part is in surface contact with the first contact part as described above, it is possible to obtain an advantageous effect of improving heat transfer properties between the board and the reflector.

According to the exemplary embodiment of the present disclosure, the lamp for a lamp may include: an insulating layer zone disposed on a part of the board; and a non-insulating layer zone disposed on another part of the board, and the first contact part may be disposed in the non-insulating layer zone.

For example, the insulating layer may be made of a photo solder resist.

Since the first contact part is disposed in the non-insulating layer zone as described above, the second contact part may be in direct contact with the first contact part without passing through the insulating layer. Therefore, it is possible to obtain an advantageous effect of inhibiting an increase in thermal resistance caused by the insulating layer and shortening a heat transfer route (a route through which heat is transferred from the first contact part to the second contact part).

According to the exemplary embodiment of the present disclosure, the lamp for a lamp may include a metal pattern layer disposed on one surface of the board, and the reflector may be connected to the board by means of the metal pattern layer and transfer heat to the board and receive heat from the board.

The metal pattern layer may have various structures and be made of various materials in accordance with required conditions and design specifications. For example, the metal pattern layer may include: a first pattern electrically connected to the light source; and a second pattern electrically disconnected from the first pattern and configured to diffuse heat generated from the light source.

Since the metal pattern layer includes the second pattern as described above, the heat generated from the light source may be inhibited from being concentrated on a particular site (e.g., a site adjacent to the light source), and the heat may be uniformly diffused to the entire board along the second pattern. Therefore, it is possible to obtain an advantageous effect of improving stability and reliability.

In particular, the first pattern may be disposed on the board to have a first area, and the second pattern may have a second area larger than the first area.

Since the area (second area) of the board occupied by the second pattern is larger than the area (first area) occupied by the first pattern as described above, it is possible to obtain an advantageous effect of further improving thermal diffusion properties implemented by the second pattern.

More particularly, the second pattern may have an area of 21 to 99% based on a total area of the board.

That is, if the second pattern has an area of less than 21% based on the total area of the board, thermal diffusion performance implemented by the second pattern may deteriorate. If the second pattern has an area of more than 99% based on the total area of the board, it may be difficult to ensure a sufficient thickness (width) of the first pattern, and electrical stability of the first pattern may deteriorate. More particularly, the second pattern may have an area of 21 to 99% based on a total area of the board.

Since the second pattern occupies a great part of the area of the board as described above, it is possible to obtain an advantageous effect of more quickly, efficiently, and stably diffusing, over a great part of the area of the board, the heat generated from the light source. Moreover, a part of the heat generated from the light source may be dissipated while being diffused along the second pattern. Therefore, it is possible to obtain an advantageous effect of improving heat dissipation performance and shortening the time for which the heat is dissipated.

According to the exemplary embodiment of the present disclosure, the lamp for a lamp may include an anodized layer disposed on the other surface of the board.

As described above, in the embodiment of the present disclosure, since the anodized layer is disposed on the other surface of the board, the heat may be dissipated even through the board itself, thereby further improving overall heat dissipation performance.

A lamp for a vehicle according to a second embodiment of the present disclosure may include: a light source part; a base plate on which the light source part is mounted; a heat dissipation part having a heat sink disposed on the base plate; and a lens part coupled to the heat dissipation part and configured to transmit light, emitted from the light source part, to the outside, in which the heat sink includes a plurality of heat dissipation fins protruding from the base plate, spaced apart from one another, and arranged radially so that intervals between the plurality of the heat dissipation fins increase outward from a central portion of the base plate.

The heat dissipation part may further include a heat dissipation fan disposed at one side of the heat sink and configured to generate an air flow.

The heat dissipation fan may be disposed on an extension line of an optical axis of the lens part and mounted at a side opposite to a side of the heat sink directed toward the base plate.

DETAILED DESCRIPTION OF THE INVENTION

Figure 1:
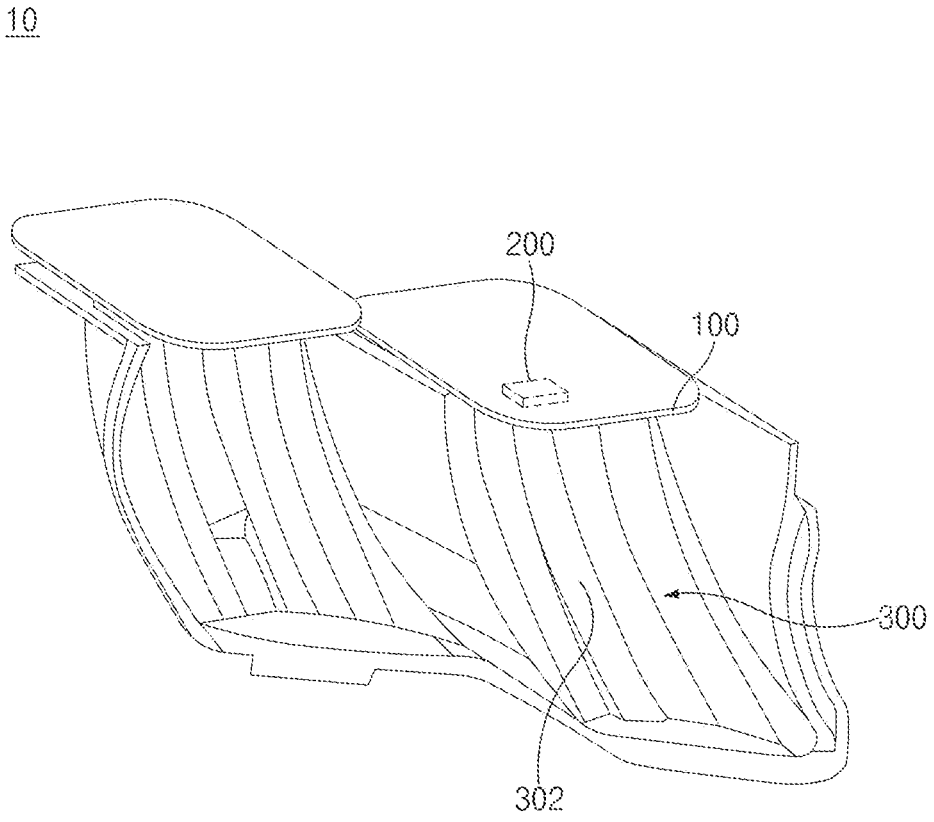
FIG. 1 is a view for explaining a lamp for a vehicle according to a first embodiment of the present disclosure.

Hereinafter, exemplary embodiments of the present disclosure will be described in detail with reference to the accompanying drawings.

However, the technical spirit of the present disclosure is not limited to some embodiments described herein but may be implemented in various different forms. One or more of the constituent elements in the embodiments may be selectively combined and substituted for use within the scope of the technical spirit of the present disclosure.

In addition, unless otherwise specifically and explicitly defined and stated, the terms (including technical and scientific terms) used in the embodiments of the present disclosure may be construed as the meaning which may be commonly understood by the person with ordinary skill in the art to which the present disclosure pertains. The meanings of the commonly used terms such as the terms defined in dictionaries may be interpreted in consideration of the contextual meanings of the related technology.

In addition, the terms used in the embodiments of the present disclosure are for explaining the embodiments, not for limiting the present disclosure.

In the present specification, unless particularly stated otherwise, a singular form may also include a plural form. The expression "at least one (or one or more) of A, B, and C" may include one or more of all combinations that can be made by combining A, B, and C.

In addition, the terms such as first, second, A, B, (a), and (b) may be used to describe constituent elements of the embodiments of the present disclosure.

These terms are used only for the purpose of discriminating one constituent element from another constituent element, and the nature, the sequences, or the orders of the constituent elements are not limited by the terms.

Further, when one constituent element is described as being 'connected', 'coupled', or 'attached' to another constituent element, one constituent element may be connected, coupled, or attached directly to another constituent element or connected, coupled, or attached to another constituent element through still another constituent element interposed therebetween.

In addition, the expression "one constituent element is provided or disposed above (on) or below (under) another constituent element" includes not only a case in which the two constituent elements are in direct contact with each other, but also a case in which one or more other constituent elements are provided or disposed between the two constituent elements. The expression "above (on) or below (under)" may mean a downward direction as well as an upward direction based on one constituent element.

Referring to FIGS. 1 to 5, a lamp 10 for a vehicle according to a first embodiment of the present disclosure includes a board 100, a light source 200 disposed on one surface of the board 100, and a reflector 300 configured to transfer heat to the board 100 and receive heat from the board 100 and having a reflective surface 302 for reflecting light beams emitted from the light source 200.

For reference, the lamp 10 for a vehicle according to the first embodiment of the present disclosure may be mainly used for a lighting function (e.g., headlamps or fog lamps) or for a signal function (e.g., turn signal lamps, tail lamps, brake lamps, or side markers). The present disclosure is not restricted or limited by the use of the lamp 10 for a vehicle.

For example, the lamp 10 for a vehicle according to the first embodiment of the present disclosure may be disposed at each of front-left and front-right sides of the vehicle and used as a headlamp for a vehicle.

The lamp 10 for a vehicle may be variously changed in structure in accordance with required conditions and design specifications. The present disclosure is not restricted or limited by the structure of the lamp 10 for a vehicle.

For example, referring to FIG. 1, the board 100 on which the light source 200 is mounted may be disposed in a housing (not illustrated). The reflector 300 may be disposed below the board 100 and reflect light beams, emitted from the light source 200, toward a location in front of a vehicle.

Figure 2:
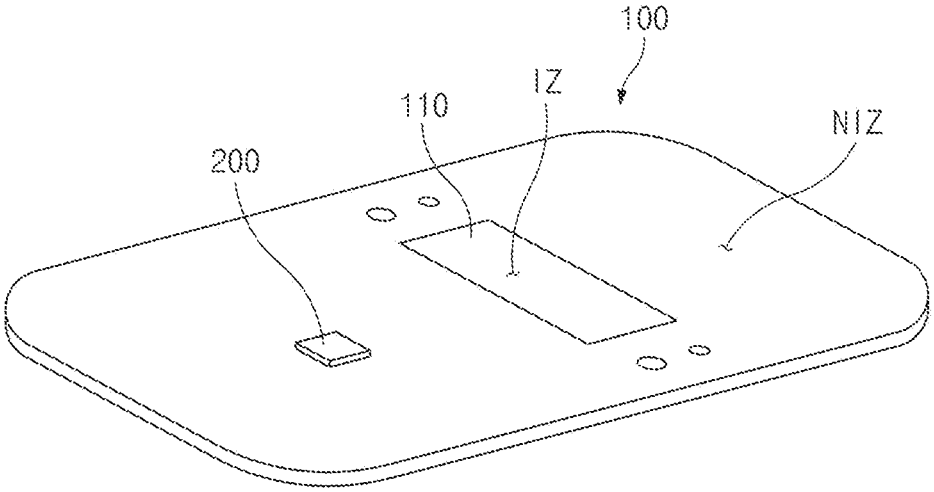
FIG. 2 is a cross-sectional view for explaining a board of the lamp for a vehicle according to the first embodiment of the present disclosure.

Referring to FIG. 2, the light source 200 is disposed on the board 100, and an electric circuit is disposed on the board 100 and electrically connected to the light source 200.

The board 100 may be variously changed in structure and size in accordance with required conditions and design specifications. The present disclosure is not restricted or limited by the structure and size of the board 100.

For example, the board 100 may be provided in the form of a quadrangular plate. According to another embodiment of the present disclosure, the board may have a circular shape, an elliptical shape, or other shapes.

In addition, the board 100 may be variously changed in material in accordance with required conditions and design specifications.

In particular, the board 100 may be made of a material capable of transferring heat to the reflector 300 and receiving heat from the reflector 300. For example, a board (e.g., a metal core PCB) made of a metallic material capable of transferring heat may be used as the board 100. According to another embodiment of the present disclosure, a nonmetallic board capable of transferring heat may be used as the board.

Various types of objects or devices mounted on the board 100 and capable of emitting light beams may be used as the light source 200. The present disclosure is not restricted or limited by the type and structure of the light source 200.

For example, a light-emitting diode (LED), which is a semiconductor light-emitting element, may be used as the light source 200. In accordance with required conditions and design specifications, a plurality of LEDs may be used to emit the light beams with the same color or different colors. According to another embodiment of the present disclosure, a laser diode, a bulb, a halogen lamp, a xenon lamp (HID), or the like may be used as the light source.

The light source 200 may be mounted directly on the board 100 or integrally attached to the board 100 by means of a bonding layer or a bonding member. The present disclosure is not restricted or limited by the method of attaching or mounting the light source 200.

The reflector 300 serves to reflect light beams emitted from the light source 200, transfer heat to the board 100, and receive heat from the board 100.

In this case, the configuration in which the board 100 and the reflector 300 may transfer and receive heat to and from each other may mean that heat from the board 100 (heat transferred from the light source to the board) may be transferred to the reflector 300.

The reflector 300 may serve to reflect the light beams, emitted from the light source 200, toward a location in front of the vehicle. The present disclosure is not restricted or limited by the shape and structure of the reflector 300.

For example, the reflector 300 may have an inner surface provided in the form of an elliptically curved surface or a free curved surface and having the reflective surface 302 (reflective layer) so as to reflect the light beams emitted from the light source 200 toward a location in front of the lamp 10 for a vehicle. Alternatively, the reflector 300 may have a structure having a single focal point or multiple focal points. In particular, the light source 200 may be disposed on the focal point of the reflector 300 or in the vicinity of the focal point of the reflector 300.

For reference, in the embodiment of the present disclosure, the configuration in which the light-emitting element emits the light beam toward a location in front of the vehicle may mean that the light-emitting element emits the light beam in a direction in which the vehicle travels. The direction indicated by the term 'front' may be changed depending on the installation position and installation direction of the lamp 10 for a vehicle.

The reflector 300 may have various structures and be made of various materials capable of transferring heat to the light source 200 and receiving heat from the light source 200. The present disclosure is not restricted or limited by the structure and material of the reflector 300.

According to the exemplary embodiment of the present disclosure, the reflector 300 may be made of a thermally conductive material, and the heat generated from the light source 200 may be dissipated through the reflector 300.

For example, the reflector 300 may be made of at least any one of thermally conductive plastic and thermally conductive metal (e.g., aluminum).

In particular, the entire reflector 300 may be made of a thermally conductive material. According to another embodiment of the present disclosure, only a part of the reflector may be partially made of a thermally conductive material.

Figure 3:
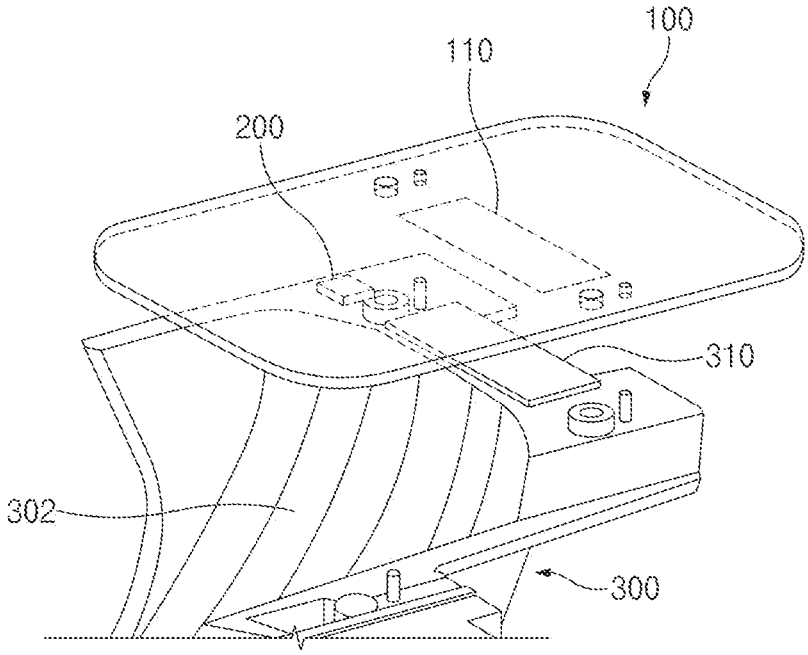
FIG. 3 is a view for explaining a reflector of the lamp for a vehicle according to the first embodiment of the present disclosure.

Referring to FIGS. 2 and 3, according to the exemplary embodiment of the present disclosure, the lamp 10 for a vehicle may include a first contact part 110 disposed on the board 100, and a second contact part 310 disposed on the reflector 300 and being in contact with the first contact part 110 so as to transfer heat to the first contact part 110 and receive heat from the first contact part 110. When the first contact part 110 and the second contact part 310 are in contact with each other (joined to each other), the board 100 and the reflector 300 may be connected to transfer and receive heat to and from each other.

The first and second contact parts 110 and 310 may have various shapes so that the first and second contact parts 110 and 310 may be in contact with each other. The present disclosure is not restricted or limited by the shapes and structures of the first and second contact parts 110 and 310.

For example, the first contact part 110 may have an approximately quadrangular shape, and the second contact part 310 may have a quadrangular shape corresponding to the shape of the first contact part 110. According to another embodiment of the present disclosure, the first and second contact parts may have other shapes such as a circular or elliptical shape. Alternatively, the first and second contact parts may have different shapes.

In particular, the first and second contact parts 110 and 310 may each have a flat surface, such that the first and second contact parts 110 and 310 may be in surface contact with each other. Since the second contact part 310 is in surface contact with the first contact part 110 as described above, it is possible to obtain an advantageous effect of improving heat transfer properties between the board 100 and the reflector 300.

According to another embodiment of the present disclosure, the first and second contact parts may have curved surfaces that may be in surface contact with each other. Alternatively, the first and second contact parts may have other structures so that the first and second contact parts may be in line or point contact with each other.

Referring to FIG. 2, according to the exemplary embodiment of the present disclosure, the lamp 10 for a vehicle may include an insulating layer zone IZ disposed on a part of the board 100, and a non-insulating layer zone NIZ provided on another part of the board 100. The first contact part 110 may be disposed in the non-insulating layer zone NIZ.

For example, the insulating layer zone IZ may be made by providing an insulating layer 120 on one surface (an upper surface based on FIG. 2) of the board 100. The non-insulating layer zone NIZ may be made by partially removing a part of the insulating layer 120.

The insulating layer 120 may be made of various materials in accordance with required conditions and design specifications. The present disclosure is not restricted or limited by the material of the insulating layer 120.

For example, the insulating layer 120 may be made of a photo solder resist. For reference, the insulating layer 120 (made of photo solder resist) may be used to protect a portion on the board 100 which need not be soldered or coated with solder.

According to another embodiment of the present disclosure, the insulating layer zone and the non-insulating layer zone may be provided on one surface of the board by printing or applying the insulating layer onto one surface of the board except for the non-insulating layer zone.

For reference, in the embodiment of the present disclosure, the configuration in which the first contact part 110 is disposed on the non-insulating layer zone NIZ may mean that the insulating layer 120 is excluded from the zone in which the first contact part 110 is disposed. The second contact part 310 may be in direct contact with the first contact part 110 without passing through another medium (insulating layer).

Since the first contact part 110 is disposed in the non-insulating layer zone NIZ as described above, the second contact part 310 may be in direct contact with the first contact part 110 without passing through the insulating layer 120. Therefore, it is possible to obtain an advantageous effect of inhibiting an increase in thermal resistance caused by the insulating layer 120 and shortening a heat transfer route (a route through which heat is transferred from the first contact part to the second contact part).

Figure 4:
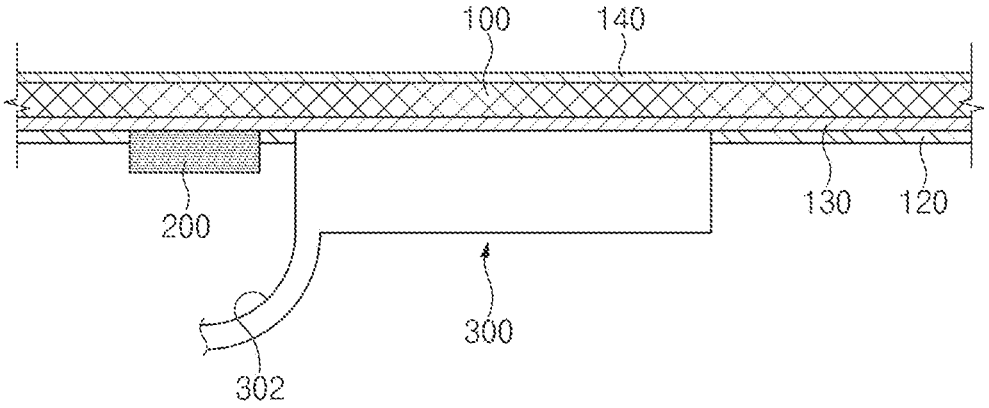
FIG. 4 is a cross-sectional view for explaining a contact structure between the board and the reflector of the lamp for a vehicle according to the first embodiment of the present disclosure.
Figure 5:
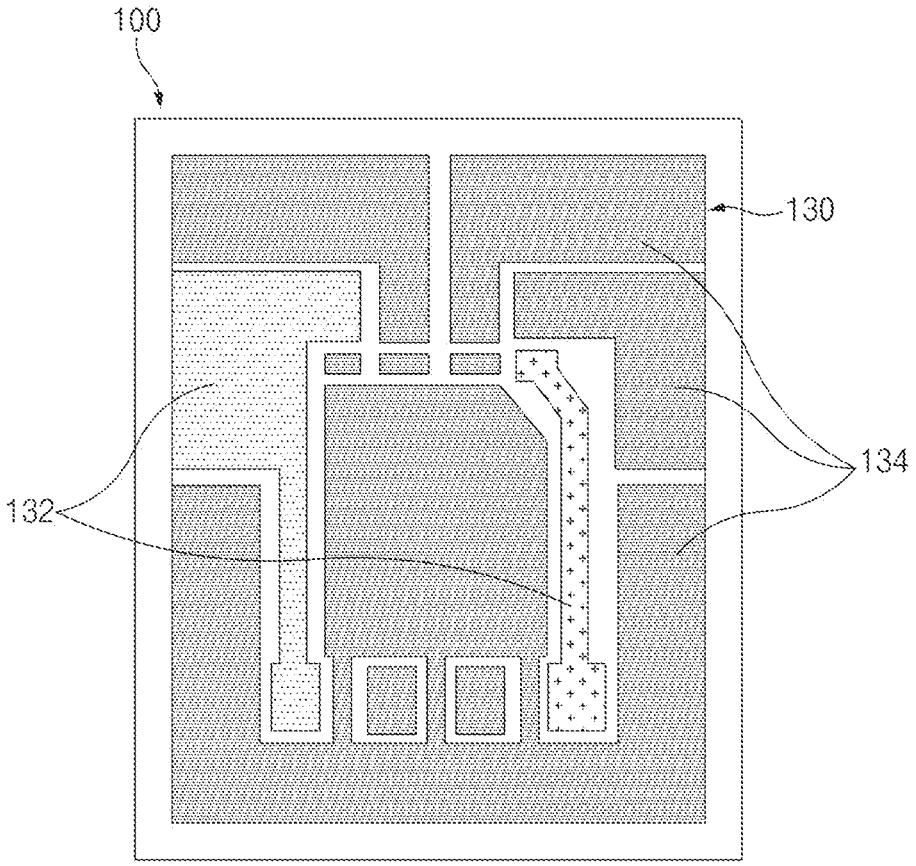
FIG. 5 is a view for explaining a metal pattern layer of the lamp for a vehicle according to the first embodiment of the present disclosure.

Referring to FIGS. 4 and 5, according to the exemplary embodiment of the present disclosure, the lamp 10 for a vehicle may include a metal pattern layer 130 disposed on one surface of the board 100. The reflector 300 may be connected to the board 100 through the metal pattern layer 130 and transfer heat to the board 100 and receive heat from the board 100.

In this case, the configuration in which the reflector 300 is connected to the board 100 through the metal pattern layer 130 and transfers heat to the board 100 and receive heat from the board 100 may mean that the heat from the board 100 (e.g., the heat generated from the light source) is transferred to the reflector 300 through the metal pattern layer 130.

The metal pattern layer 130 may have various structures and be made of various materials in accordance with required conditions and design specifications. The present disclosure is not restricted or limited by the structure and material of the metal pattern layer 130. For example, the metal pattern layer 130 may be made of copper (Cu).

According to the exemplary embodiment of the present disclosure, the metal pattern layer 130 may include a first pattern 132 electrically connected to the light source 200, and a second pattern 134 electrically separated from the first pattern 132 and configured to diffuse the heat generated from the light source 200.

The first pattern 132 may constitute an electric circuit (e.g., a cathode electrode pattern and an anode electrode pattern) electrically connected to the light source 200, and the second pattern 134 may serve to diffuse the heat generated from the light source 200 (e.g., diffuse the heat along a surface of the board).

Since the metal pattern layer 130 includes the second pattern 134 as described above, the heat generated from the light source 200 may be inhibited from being concentrated on a particular site (e.g., a site adjacent to the light source), and the heat may be uniformly diffused to the entire board 100 along the second pattern 134. Therefore, it is possible to obtain an advantageous effect of improving stability and reliability.

In particular, the first pattern 132 may have a first area on the board 100, and the second pattern 134 may have a second area larger than the first area.

Since the area (second area) of the board 100 occupied by the second pattern 134 is larger than the area (first area) occupied by the first pattern 132 as described above, it is possible to obtain an advantageous effect of further improving thermal diffusion properties implemented by the second pattern 134.

More particularly, the second pattern 134 may occupy about 21% to about 99% of a total area of the board 100 (a total area of one surface of the board).

That is, if the second pattern 134 has an area of less than 21% based on the total area of the board 100, thermal diffusion performance implemented by the second pattern 134 may deteriorate. If the second pattern 134 has an area of more than 99% based on the total area of the board 100, it may be difficult to ensure a sufficient thickness (width) of the first pattern 132, and electrical stability of the first pattern 132 may deteriorate. Therefore, the second pattern 134 may have an area of 21 to 99% based on the total area of the board 100. Hereinafter, an example will be described in which the second pattern 134 has an area of about 80% based on the total area of the board 100.

Since the second pattern 134 occupies a great part of the area of the board 100 (e.g., an area corresponding to 80% based on the total area of the board) as described above, it is possible to obtain an advantageous effect of more quickly, efficiently, and stably diffusing, over a great part of the area of the board 100, the heat generated from the light source 200. Moreover, a part of the heat generated from the light source 200 may be dissipated while being diffused along the second pattern 134. Therefore, it is possible to obtain an advantageous effect of improving heat dissipation performance and shortening the time for which the heat is dissipated.

According to the exemplary embodiment of the present disclosure, the lamp 10 for a vehicle may include an anodized layer 140 disposed on the other surface (a bottom surface based on FIG. 2) of the board 100.

As described above, in the embodiment of the present disclosure, since the anodized layer 140 is provided on the other surface of the board 100, the heat (the heat generated from the light source) may be dissipated even through the board 100 itself, thereby further improving overall heat dissipation performance.

The anodized layer 140 may be provided in various ways in accordance with required conditions and design specifications.

For example, the anodized layer 140 may be provided by anodizing (black anodizing) the other surface of the board 100.

In particular, the anodized layer 140 may be provided on the entirety of the other surface of the board 100. According to another embodiment of the present disclosure, the anodized layer may be provided on a part of the other surface of the board.

According to the embodiment of the present disclosure described above, it is possible to obtain an advantageous effect of simplifying the structure and improving the spatial utilization and the degree of design freedom.

In particular, according to the embodiment of the present disclosure, it is possible to obtain an advantageous effect of effectively dissipating the heat generated from the light source using the reflector without a separate heat dissipation member.

In addition, according to the embodiment of the present disclosure, it is possible to obtain an advantageous effect of shortening the dissipation route (heat transfer route) of the heat generated from the light source and improving the heat dissipation performance.

In addition, according to the embodiment of the present disclosure, it is possible to obtain an advantageous effect of improving the operational stability and reliability of the light source and prolonging the lifespan.

In addition, according to the embodiment of the present disclosure, it is possible to obtain an advantageous effect of simplifying the structure and the manufacturing process and reducing the costs.

Figure 6:
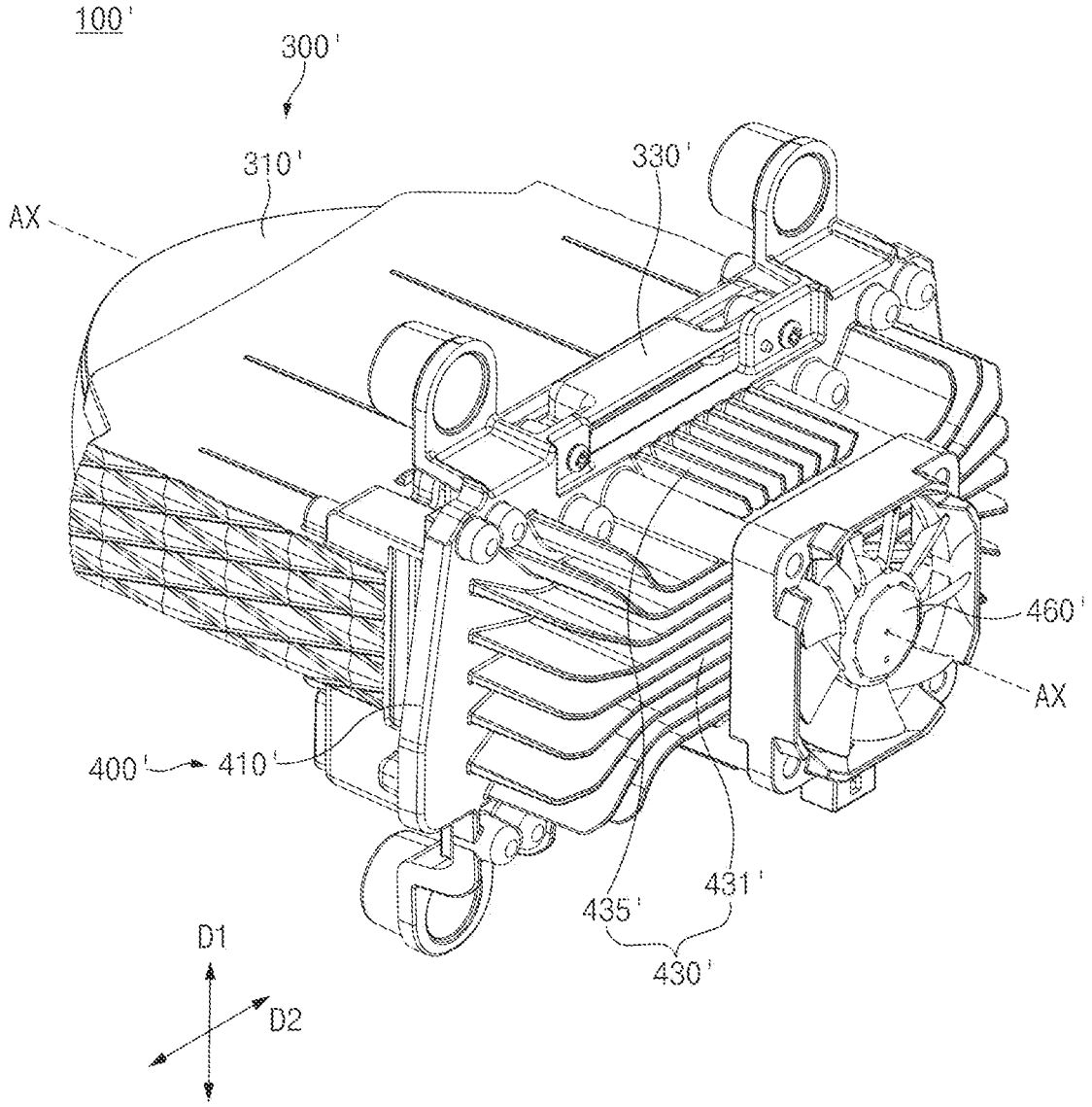
FIG. 6 is a perspective view illustrating a lamp for a vehicle according to a second embodiment of the present disclosure.
Figure 7:
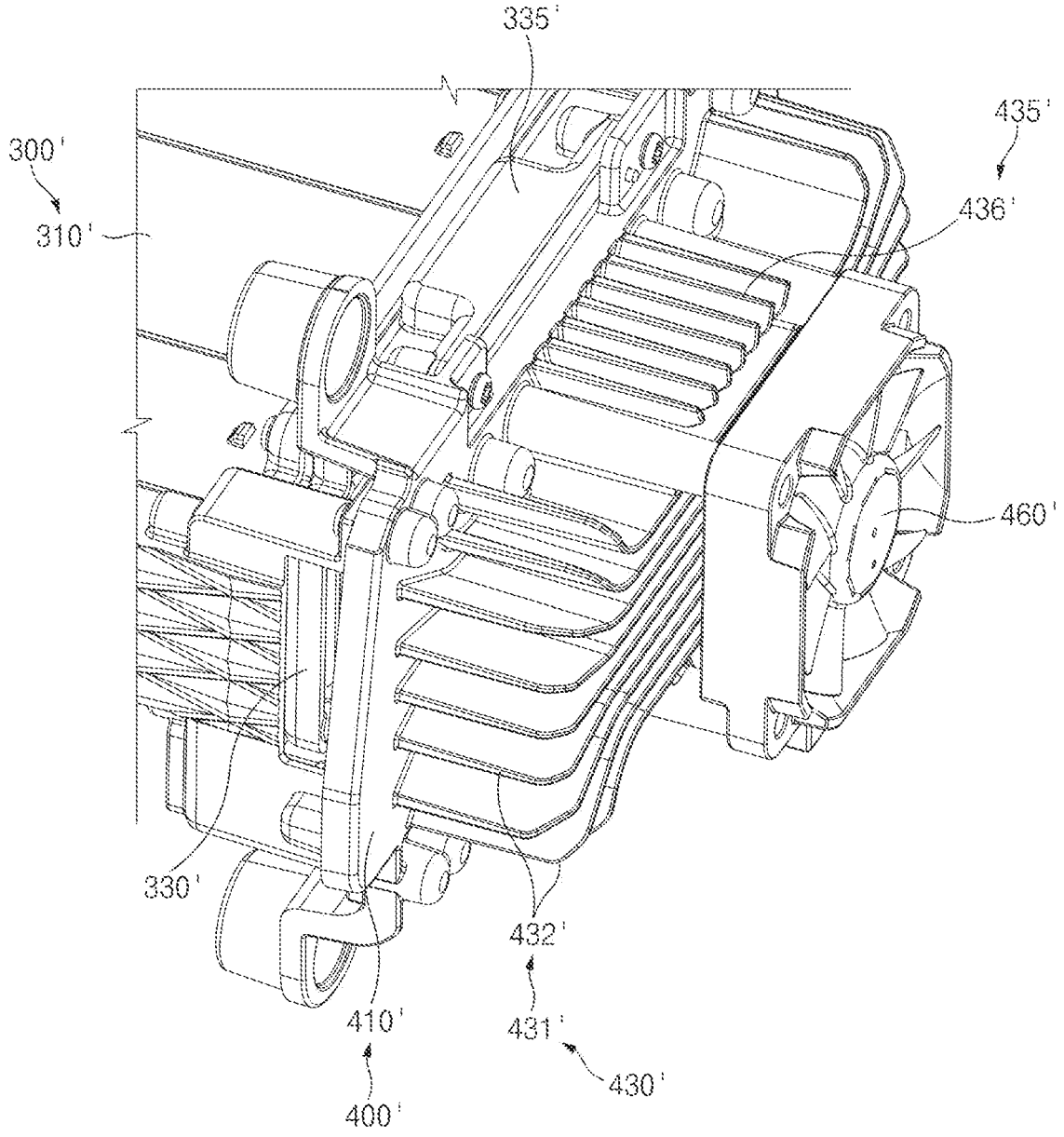
FIG. 7 is an enlarged perspective view illustrating a part of the lamp for a vehicle illustrated in FIG. 6.
Figure 8:
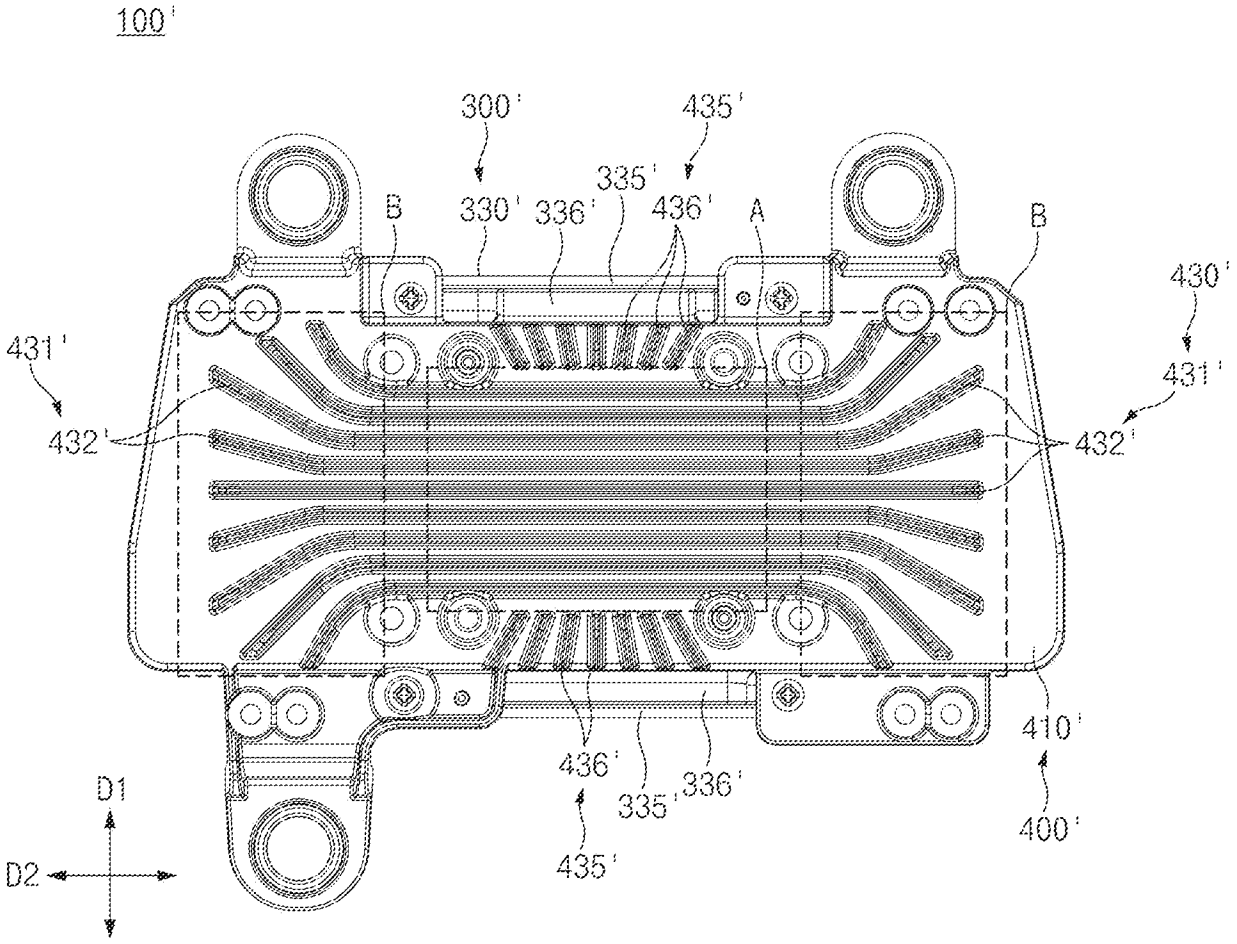
FIG. 8 is a rear view illustrating the lamp for a vehicle according to the second embodiment of the present disclosure when viewed from the rear side.
Figure 9:
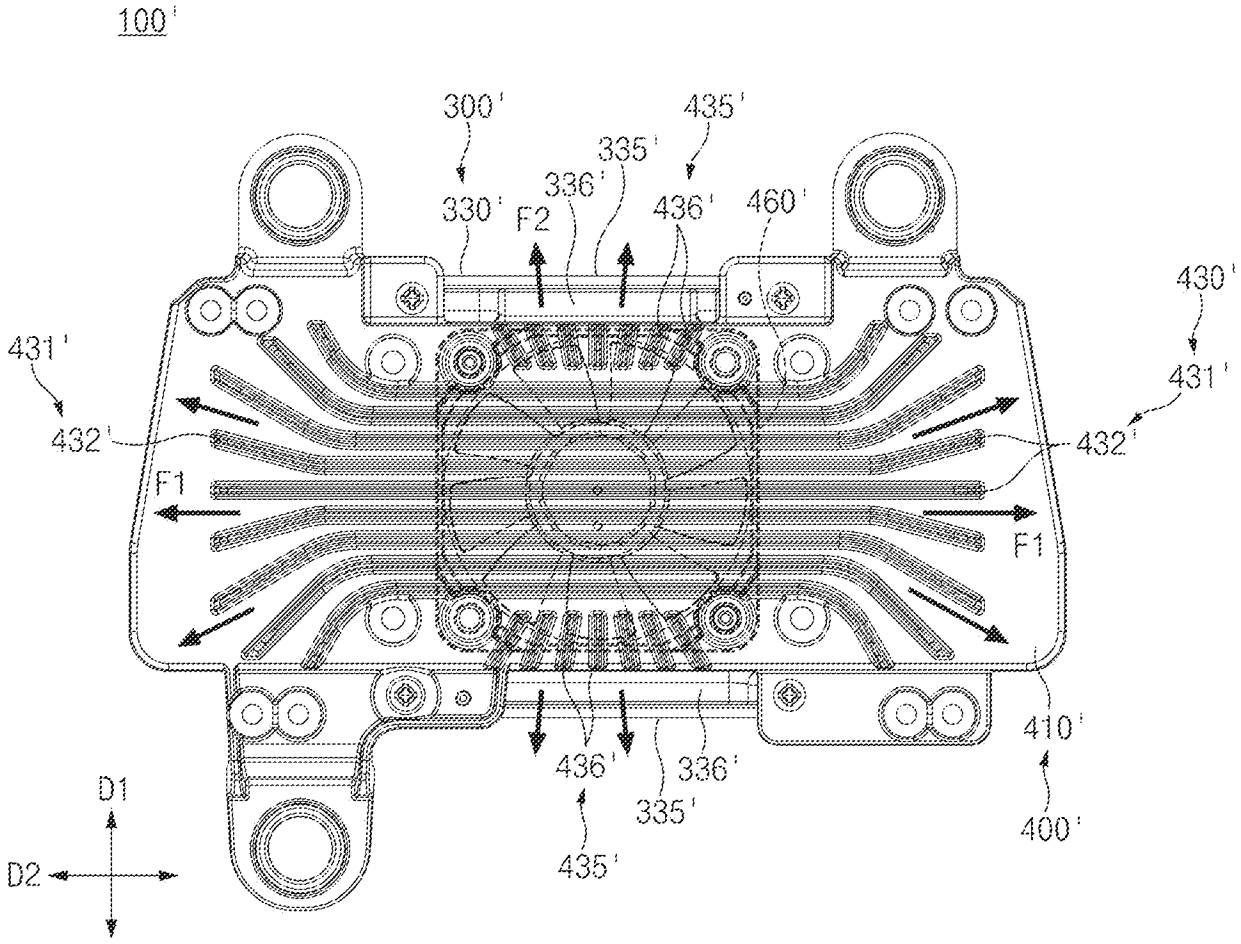
FIG. 9 is a view illustrating a flow of air in a heat sink of the lamp for a vehicle according to the second embodiment of the present disclosure.
Figure 10:
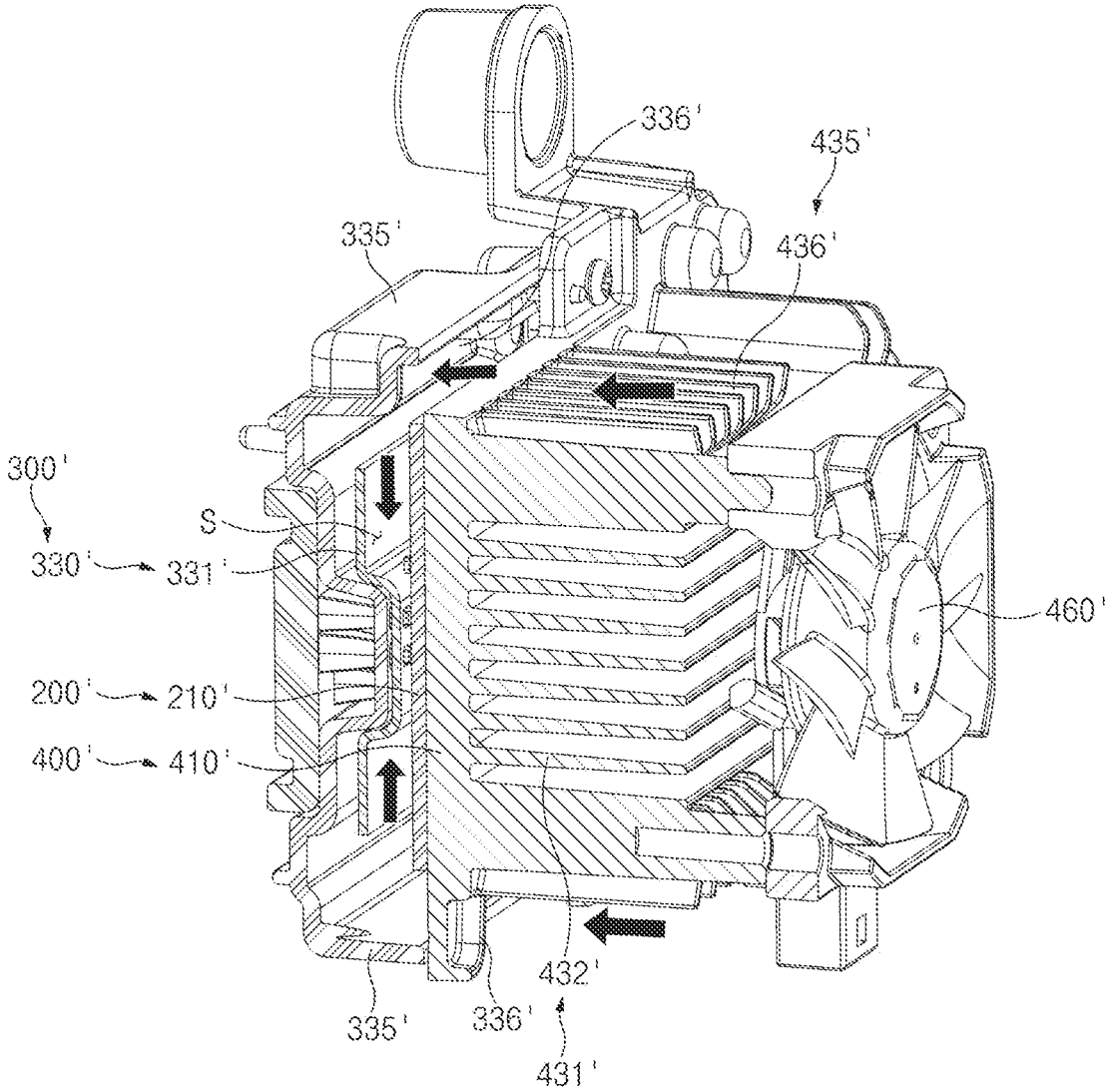
FIG. 10 is an enlarged cross-sectional perspective view illustrating the lamp for a vehicle according to the second embodiment of the present disclosure.
Figure 11:
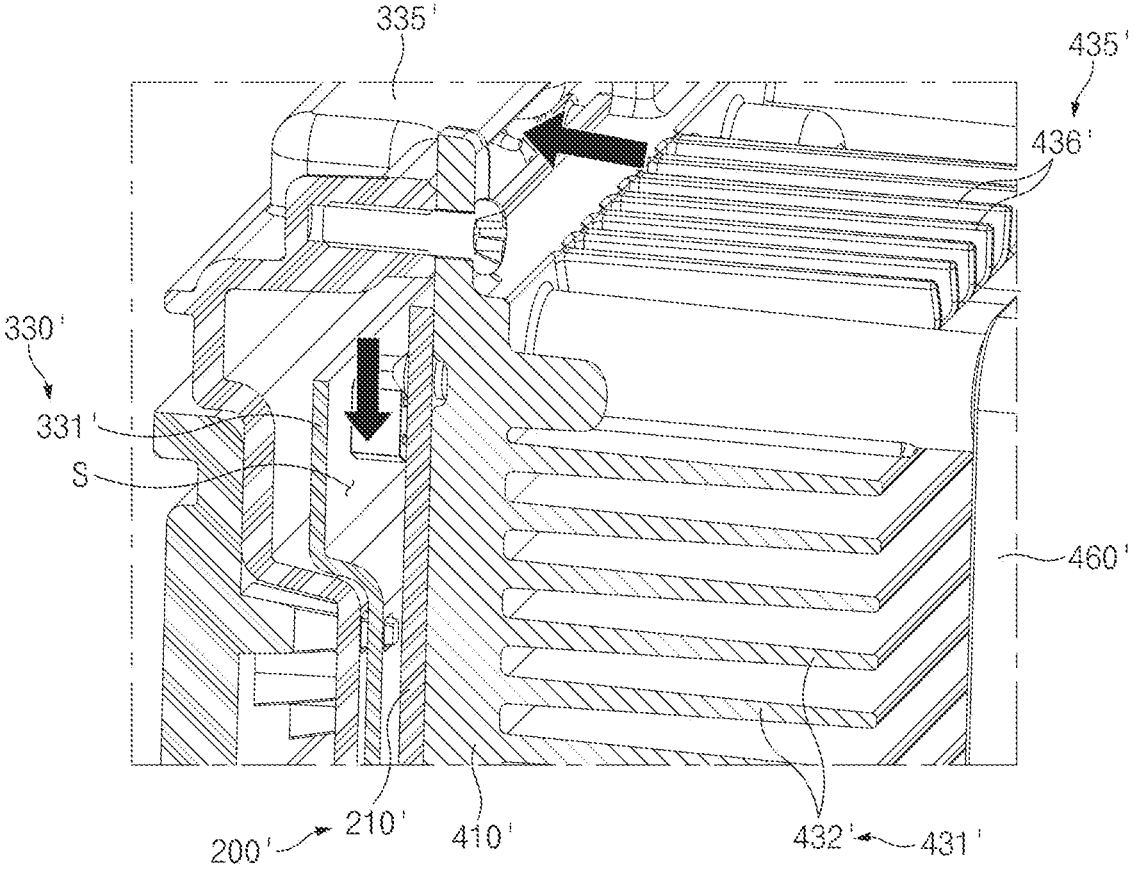
FIG. 11 is an enlarged cross-sectional perspective view of a part of FIG. 10 for explaining a second heat sink and a guide part.
Figure 12:
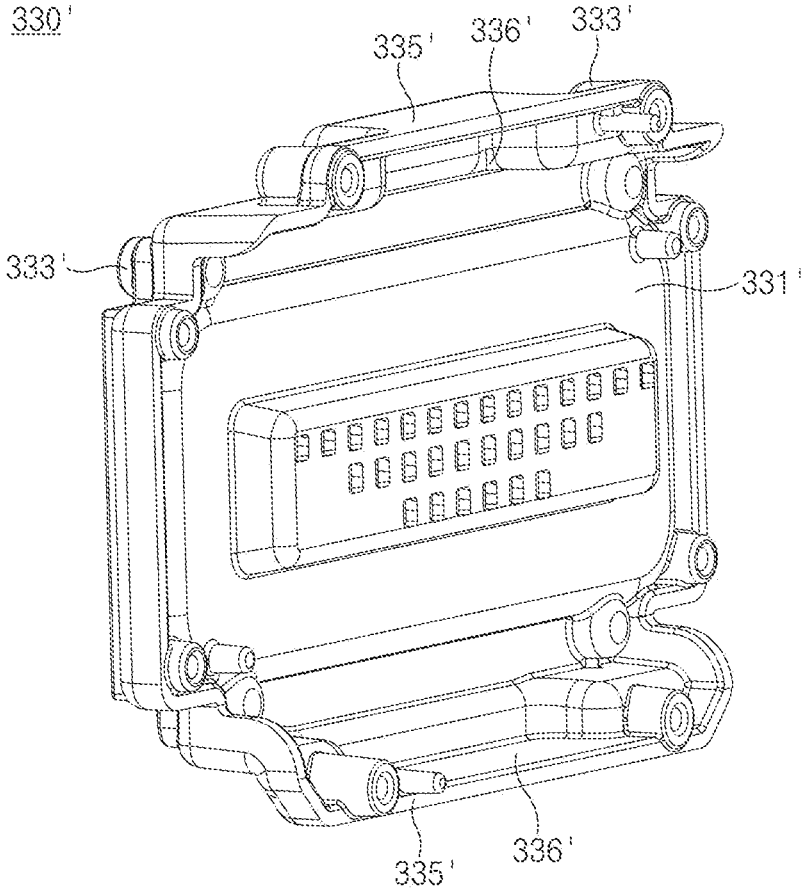
FIG. 12 is a perspective view illustrating a lens holder according to the second embodiment of the present disclosure.

Meanwhile, FIG. 6 is a perspective view illustrating a lamp for a vehicle according to a second embodiment of the present disclosure. In addition, FIG. 7 is an enlarged perspective view illustrating a part of the lamp for a vehicle illustrated in FIG. 6. In addition, FIG. 8 is a rear view illustrating the lamp for a vehicle according to the second embodiment of the present disclosure when viewed from the rear side. In addition, FIG. 9 is a view illustrating a flow of air in a heat sink of the lamp for a vehicle according to the second embodiment of the present disclosure. In addition, FIG. 10 is an enlarged cross-sectional perspective view illustrating the lamp for a vehicle according to the second embodiment of the present disclosure. In addition, FIG. 11 is an enlarged cross-sectional perspective view of a part of FIG. 10 for explaining a second heat sink and a guide part. In addition, FIG. 12 is a perspective view illustrating a lens holder according to the second embodiment of the present disclosure.

Referring to FIGS. 6 to 12, a lamp 100' for a vehicle according to the second embodiment of the present disclosure includes a light source part 200', a heat dissipation part 400', and a lens part 300'.

The light source part 200' may include a single light source (not illustrated) or a plurality of light sources (not illustrated) configured to emit light beams. In this case, the type and properties of the light source are not limited. For example, a light-emitting diode (LED), which is a semiconductor light-emitting element, may be used as the light source, or a plurality of LEDs configured to emit light beams with an identical color or different colors may be used in accordance with required conditions and design specifications. However, the light source applied to the present disclosure is not limited thereto. For example, a laser diode, a bulb, a halogen lamp, a xenon (HID) lamp, and the like may be used.

For example, the light source part 200' may include a reflector (not illustrated) configured to reflect forward light beams emitted from the light source. In addition, the lamp 100' for a vehicle may further include a shield part (not illustrated). The shield part may selectively block some of the light beams emitted from the light source part 200' depending on a beam pattern, thereby implementing various beam patterns.

The heat dissipation part 400' includes a base plate 410' on which the light source part 200' is mounted, and a heat sink 430' disposed on the base plate 410'.

Specifically, the heat dissipation part 400' may serve to dissipate heat to prevent an increase in temperature caused by high-temperature heat generated by the light source part 200'. The heat dissipation part 400' may include the base plate 410' and the heat sink 430'. The base plate 410' may have a plate shape. The light source part 200' may be mounted on one surface of the base plate 410', and the heat sink 430' may be provided on the other surface opposite to one surface.

In addition, the heat dissipation part 400' may further include a heat dissipation fan 460' provided at one side of the heat sink 430' and configured to generate an air flow. For example, the heat dissipation fan 460' may be rotated by outside air introduced into the vehicle and generate an air flow in the lamp by being rotated.

The lens part 300' is coupled to the heat dissipation part 400' and transmits, to the outside, the light beams emitted from the light source part 200'.

Specifically, the lens part 300' may include a lens 310' and a lens holder 330'.

The lens 310' may transmit the light beams, emitted from the light source and reflected by the reflector, toward a location in front of the vehicle. In this case, the types and properties of the lens 310' are not limited, and various lenses may be applied in accordance with required conditions and design specifications.

The lens holder 330' may fix the lens 310' and be coupled to the heat dissipation part 400'. Specifically, the lens 310', the lens holder 330', the base plate 410', and the heat sink 430' may be sequentially disposed along an optical axis AX of the lens 310'. That is, the lens holder 330' may be coupled to a front side of the base plate 410', i.e., a side directed toward the lens 310'. The heat sink 430' may protrude from a rear side of the base plate 410' which is opposite to the front side of the base plate 410'.

The heat sink 430' may include a plurality of heat dissipation fins 432' and 436' protruding from the base plate 410' and spaced apart from one another. In addition, the heat sink 430' may be disposed radially such that intervals between the plurality of heat dissipation fins 432' and 436' increase outward from a central portion of the base plate 410'.

Specifically, the heat dissipation fins 432' and 436' may be integrated with the base plate 410'. The plurality of heat dissipation fins 432' and 436' may each have a plate shape. The intervals between the heat dissipation fins 432' and 436' may define flow paths that guide the air flow generated by the heat dissipation fan 460'.

Referring to FIGS. 6 to 8, the heat sink 430' may be disposed radially such that the intervals between the plurality of heat dissipation fins 432' and 436' increase outward from the central portion of the base plate 410'. Specifically, the heat dissipation fins 432' and 436' each having a plate shape may be arranged on the base plate 410' and spaced apart from one another in a single direction or a plurality of directions. The plurality of heat dissipation fins 432' and 436' may be disposed to become distant from one another as the distance from the center to the outside increases. The plurality of heat dissipation fins 432' and 436' may be shaped to implement the radial shape. For example, the plurality of heat dissipation fins 432' and 436' may be inclined at different angles or curved toward ends thereof.

Since the heat sink 430' is configured such that the intervals between the plurality of heat dissipation fins 432 and 436' increase as the distance from the center of the heat sink 430' increases, it is possible to promote the air flow that moves the high-temperature air at the center of the heat dissipation part 400' to the outside. As described above, the heat dissipation part 400' may increase utilization of a flow velocity generated by the heat dissipation fan 460' and ensure a sufficient heat dissipation area, thereby improving heat dissipation performance.

In addition, the heat dissipation part 400' may optimize the heat dissipation performance, thereby reducing a size of the heat sink 430' and thus reducing costs.

In addition, according to the embodiment of the present disclosure, a volume of the heat sink 430' may be reduced, such that the heat sink 430' may be used in common for various lamp modules.

Meanwhile, the heat dissipation fan 460' may be disposed on an extension line of the optical axis AX of the lens part 300' and mounted at a side opposite to a side of the heat sink 430' directed toward the base plate 410'.

Specifically, referring to the drawings, when a side directed toward the lens 310' is a front side based on the heat dissipation part 400' and a side opposite to the front side is a rear side, the heat dissipation fan 460' may be mounted at the rear side of the heat sink 430'. As described above, the plurality of heat dissipation fins 432' and 436' may protrude rearward from the base plate 410', and the heat dissipation fan 460' may be mounted at the rear side of the heat sink 430', i.e., the rear side of the heat dissipation fins 432' and 436'. Thus, a direction of an inflow of air made by the heat dissipation fan 460' may be parallel to a direction in which the heat dissipation fins 432' and 436' protrude. That is, a rotation direction of the heat dissipation fan 460' may be perpendicular to the direction in which the heat dissipation fins 432' and 436' protrude.

Therefore, the heat dissipation part 400' may maximize efficiency of heat exchange between air (outside air) introduced from the heat dissipation fan 460' and high-temperature air from the heat sink 430'. The mounting position of the heat dissipation fan 460' may improve the heat dissipation efficiency of the heat dissipation part 400'.

Hereinafter, for the convenience of description, any one direction, among the directions parallel to the base plate 410', is defined as a first direction D1 (a vertical direction based on the drawings), and a direction perpendicular to the first direction D1 is defined as a second direction D2 (a horizontal direction based on the drawings).

The heat sink 430' includes a first heat sink 431' and a second heat sink 435'.

The first heat sink 431' may include the plurality of first heat dissipation fins 432' disposed to be spaced apart from one another in the first direction D1 and implement an air flow toward the outside from the center of the heat sink 430'.

Hereinafter, for the convenience of description, among the regions of the first heat sink 431', a region, which is a central region in which the air introduced into the first heat sink 431' by the heat dissipation fan 460' begins to flow, is defined as a first region A, and regions at two opposite sides of the first region A in the second direction D2 are defined as second regions B.

In this case, the interval between the first heat dissipation fins 432' in the second region B may be larger than the interval between the first heat dissipation fins 432' in the first region A. Therefore, the air flow may be promoted from the first region A to the second region B.

In addition, the intervals between the plurality of first heat dissipation fins 432' in the second region B may increase outward. Therefore, the air moving from the first region A to the second region B may be more effectively discharged to the outside.

For example, at least some of the plurality of first heat dissipation fins 432' in the second region B may be curved in a direction in which the distance from the center of the first region A in the first direction D1 increases. Specifically, when the heat dissipation fin, which is disposed at the center of the plurality of first heat dissipation fins 432' based on the upward/downward direction illustrated in FIG. 8, is defined as a first reference heat dissipation fin 432', the first heat dissipation fins 432' positioned at an upper side of the first reference heat dissipation fin 432' may extend to be curved upward toward the ends thereof. In addition, the first heat dissipation fins 432' positioned at a lower side of the first reference heat dissipation fin 432' may extend to be curved downward toward the ends thereof.

In addition, the degree to which the plurality of first heat dissipation fins 432' is curved may increase as the distance from the center in the first direction D1 increases. That is, the degree to which the first heat dissipation fins 432' is curved upward or downward may increase as the distance from the first reference heat dissipation fin 432' increases.

The above-mentioned shapes of the first heat dissipation fins 432' disposed on the first heat sink 431' may implement an optimal shape capable of discharging the high-temperature air to the outside. Specifically, the air flow from the first region A to the second region B may be promoted when the air flow is made by the heat dissipation fan 460'.

In addition, the shapes of the first heat dissipation fins 432' in the second region B may effectively discharge, to the outside of the first heat sink 431', the air moving from the first region A to the second region B.

Therefore, the high-temperature air having passed through the first heat dissipation fins 432' moves toward an outer surface of the first heat sink 431', i.e., an inner surface of a lamp housing (not illustrated), such that a temperature difference in the lamp may be constantly maintained. Therefore, it is possible to minimize the occurrence of moisture in the lamp.

The second heat sink 435' includes the plurality of second heat dissipation fins 436' disposed at one side and the other side in the first direction D1 of the first heat sink 431' and spaced apart from one another in the second direction D2. The plurality of second heat dissipation fins 436' may implement the air flow from the heat sink 430' to the light source part 200'.

In addition, the second heat dissipation fins 436' may be spaced apart from the first heat dissipation fins 432' in the first direction D1. Specifically, based on the direction illustrated in FIG. 8, the second heat dissipation fins 436' may be spaced apart from the first heat dissipation fins 432' in the upward or downward direction (the first direction D1). In addition, the plurality of second heat dissipation fins 436' may be arranged to be spaced apart from one another in a leftward/rightward direction (the second direction D2).

For example, to implement the radial shape, the plurality of second heat dissipation fins 436' may be inclined in a direction in which the distance from the center of the first heat dissipation fins 432' in the second direction D2 increases. In addition, an inclination angle of each of the plurality of second heat dissipation fins 436' may increase as the distance from the center in the second direction D2 increases.

Specifically, based on the upward/downward direction and the leftward/rightward direction illustrated in FIG. 8, the second heat dissipation fins 436' disposed at the upper side of the first heat dissipation fins 432' may be inclined upward as the distance from the center increases. Further, the second heat dissipation fins 436' disposed at the lower side of the first heat dissipation fins 432' may be inclined downward as the distance from the center increases.

In this case, the degree to which the plurality of second heat dissipation fins 436' is inclined may increase as the distance from the center increases in the second direction D2.

Meanwhile, referring to FIGS. 9 to 12, the lens holder 330' may guide, to the light source part 200', the air which is allowed to flow by the heat dissipation fan 460' and passes through the second heat sink 435'. That is, as described above, the lens holder 330' may be coupled to the lens 310' and the base plate 410' and serve to fix the lens 310'. The lens holder 330' may also serve as a duct for transmitting a part of the air, generated by the heat dissipation fan 460', directly to the light source part 200'.

Specifically, the lens holder 330' may include a body part 331', a fixing part 333', and guide parts 335'.

A separation space S may be defined between the body part 331' and the base plate 410' so that the light source part 200' is disposed between the body part 331' and the base plate 410'.

For example, when the LED is used as the light source, a board 210' on which the LED (light source) is mounted may be attached to a surface of the base plate 410' directed toward the lens part 300'. Further, the body part 331' may be spaced apart from the base plate 410', thereby defining the separation space S that accommodates the light source part 200'.

The fixing part 333' may fix the lens 310' and be disposed at a side opposite to a side of the body part 331' directed toward the heat dissipation part 400'. In this case, the method of fixing the lens 310' by the fixing part 333' may be, but not limited to, bolting, for example.

The guide parts 335' may be provided at one end and the other end in the second direction D2 of the body part 331' and disposed at positions corresponding to the second heat sink 435'. Air inflow parts 336' may be provided so that the air having passed through the second heat sink 435' enters the separation space S.

Specifically, the separation space S may communicate with the second heat sink 435' through the air inflow parts 336'. Since the second heat dissipation fins 436' are arranged in the second direction D2 (the leftward/rightward direction based on the drawings), the flow path of the air disposed between the second heat dissipation fins 436' may be directed toward the air inflow parts 336' from the heat dissipation fan 460'.

In this case, the guide parts 335' may be integrated with the upper end and the lower end of the body part 331'. The air inflow parts 336' may be positioned at positions corresponding to the second heat dissipation fins 436' disposed at the upper side of the first heat dissipation fins 432' and to the second heat dissipation fins 436' disposed at the lower side of the first heat dissipation fins 432'. The guide part 335' may have a curved shape to move the air, introduced through the air inflow part 336', to the light source part 200'.

The light source and the lens 310' may be cooled directly by the air introduced into the separation space S by the guide parts 335' of the lens holder 330', such that the cooling efficiency implemented by the heat dissipation part 400' may be maximized.

Meanwhile, hereinafter, the air flow made by the heat dissipation part 400' according to the second embodiment of the present disclosure will be described with reference to FIGS. 9 to 12.

Referring to FIG. 9, the air allowed to flow by the heat dissipation fan 460' may be introduced into the first heat sink 431' and the second heat sink 435'.

First, most of the air introduced between the first heat dissipation fins 432' is first introduced into the first region A which is a region adjacent to the heat dissipation fan 460'. The air introduced into the first region A may quickly flow to the second region B by a difference between the interval between the first heat dissipation fins 432' in the first region A and the interval between the first heat dissipation fins 432' in the second region B. Further, the air introduced into the second region B may be moved to the outside of the second heat sink 435' quickly by the radial shape of the first heat dissipation fins 432' in the second region B. That is, the air may be moved to the inner surface of the lamp housing (see the direction F1 in FIG. 9).

The air may be circulated in the second direction D2 (the horizontal direction based on the drawings) in the lamp by the first heat sink 431' and cool the light source part 200'. In addition, a temperature difference in the lamp is minimized, which makes it possible to prevent moisture from occurring in the lamp.

Referring to FIGS. 9 to 12, the air introduced between the second heat dissipation fins 436' may be moved in the direction (the upward/downward direction) away from the first heat dissipation fins 432' by the radial shape of the second heat dissipation fins 436' (see the direction F2 in FIG. 9). Thereafter, the moved air may be introduced into the air inflow parts 336' of the lens holder 330' by the flow made by the heat dissipation fan 460', guided by the shape of the guide parts 335', and moved into the separation space S which is a space between the base plate 410' and the body part 331' (see the directions indicated by the arrows illustrated in FIGS. 10 and 11).

The air moved into the separation space S may directly cool the light source part 200' and the lens part 300', thereby maximizing the cooling efficiency implemented by the heat dissipation part 400'.

According to the lamp for a vehicle according to the present disclosure described above, the shape of the heat dissipation fin disposed on the heat dissipation part is improved, and the heat dissipation fan is disposed at the rear end of the heat sink, which makes it possible to improve the heat dissipation performance.

In addition, according to the present disclosure, the shape of the heat sink and the shape of the lens holder are improved, and the light source part is cooled directly by the air allowed to flow by the heat dissipation fan, which makes it possible to maximize the heat dissipation performance.

In addition, according to the present disclosure, the heat dissipation part may optimize the heat dissipation performance, thereby reducing the size of the heat sink and thus reducing costs.

In addition, according to the present disclosure, the volume of the heat sink may be reduced, such that the heat sink may be used in common for various lamp modules.

While the embodiments have been described above, the embodiments are just illustrative and not intended to limit the present disclosure. It can be appreciated by those skilled in the art that various modifications and applications, which are not described above, may be made to the present embodiment without departing from the intrinsic features of the present embodiment. For example, the respective constituent elements specifically described in the embodiments may be modified and then carried out. Further, it should be interpreted that the differences related to the modifications and applications are included in the scope of the present disclosure defined by the appended claims.

What is claimed is:

1. A lamp for a vehicle, comprising:

a board having first and second surfaces facing mutually opposite directions;

a metal pattern layer disposed on the first surface of the board and having first and second patterns electrically separated from each other, the second pattern including a first contact portion;

an insulation layer disposed on the metal pattern layer and having a plurality of openings exposing portions of the metal pattern layer, the plurality of openings including (1) a first opening exposing a portion of the first pattern of the metal pattern layer and (2) a second opening exposing the first contact portion of the second pattern of the metal pattern layer;

a light source configured to emit light and disposed on and in contact with the exposed portion of the first pattern of the metal pattern layer; and a reflector configured to transfer heat to and from the board and having (1) a reflective surface configured to reflect the light emitted from the light source and (2) a second contact portion disposed on and in contact with the exposed first contact portion of the second pattern of the metal pattern layer.

2. The lamp of claim 1, wherein the reflector comprises a thermally conductive material and configured to dissipate heat generated from the light source.

3. The lamp of claim 2, wherein the reflector comprises at least one of thermally conductive plastic and thermally conductive metal.

4. The lamp of claim 1, wherein the first contact portion of the second pattern of the metal pattern layer is in surface contact with the second contact portion of the reflector.

5. The lamp of claim 1 wherein the insulation layer comprises a photo solder resist.

6. The lamp of claim 1, wherein the first pattern is disposed on a first area of the board, and the second pattern is disposed on a second area of the board, the second area being larger than the first area.

7. The lamp of claim 6, wherein the second pattern of the metal pattern layer occupies from about 21% to about 99% of a total surface area of the board.

8. The lamp of claim 1, further comprising an anodized layer disposed on the second surface of the board.

* * * * *